US006402562B1

(12) United States Patent
Chang et al.

(10) Patent No.: US 6,402,562 B1
(45) Date of Patent: Jun. 11, 2002

(54) ELECTRICAL CONNECTOR

(75) Inventors: Guo Hua Chang; Zi Qi Hu; Zi Qiang Zhu; Jin Kui Hu, all of Kun-Shan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/799,970

(22) Filed: Mar. 5, 2001

(30) Foreign Application Priority Data

Dec. 20, 2000 (TW) ..... 89222126 U

(51) Int. Cl.[7] ..... H01R 13/648
(52) U.S. Cl. ..... 439/676; 439/607
(58) Field of Search ..... 439/676, 701, 439/607–610

(56) References Cited

U.S. PATENT DOCUMENTS 5,478,261 A * 12/1995 Bogese, II ..... 439/676
5,759,070 A * 6/1998 Belopolsky ..... 439/676
6,010,367 A * 1/2000 Wu ..... 439/620
6,183,308 B1 * 2/2001 Laity ..... 439/676
6,210,237 B1 * 4/2001 Chang ..... 439/607
6,213,809 B1 * 4/2001 Viklund ..... 439/676

* cited by examiner

*Primary Examiner*—Gary Paumen
(74) *Attorney, Agent, or Firm*—Wei Te Chung

(57) ABSTRACT

An electrical connector (1) includes an insulative housing (2), first and second terminal modules (3), (4), first and second insulative covers (5), (6), a pair of board locks (7) and a conductive shield (8). The first and second terminal modules each includes a dielectric spacer (30), (40) and a plurality of electrical terminals (32), (42) extending through the dielectric spacer. The first and second covers each defines a plurality of bottom passageways (54) for partially accommodating the electrical terminals of the first and second terminal modules, respectively. The shield includes a top wall (80) being separated from the electrical terminals by the dielectric spacers and the insulative covers.

1 Claim, 4 Drawing Sheets

ELECTRICAL CONNECTOR

BACKGROUND OF THE INVENTION

1. Field of the Invention

The present invention relates to an electrical connector, and particularly to an electrical connector which is capable of enduring an accidentally high voltage.

2. Description of the Related Art

Referring to FIG. 4, a conventional electrical connector 9 comprises an insulative housing 90, a terminal module 92 and a conductive shield 94 covering at least a top face of the insulative housing 90. The terminal module 92 comprises a dielectric spacer 920 and a plurality of electrical terminals 921 extending through the dielectric spacer 920. Each electrical terminal 921 comprises a fixing portion 921*a* embedded in the dielectric spacer 920, a contacting portion 921*b* extending beyond a front face of the dielectric spacer 920 from one end of the fixing portion 921*a* to electrically connect with electrical terminals of a complementary electrical connector (not shown), and a mounting portion 921*c* extending beyond the dielectric spacer 920 from an opposite end of the fixing portion 921*a* to be mounted to a printed circuit board (not shown). The contacting portions 921*b* of the electrical terminals 921 are bent at an angle relative to the fixing portions 921*a*, thereby defining curved portions 921*d* therebetween. When the terminal module 92 and the conductive shield 94 are assembled with the insulative housing 90, the curved portions 921*d* of the electrical terminals 921 and a top wall 940 of the conductive shield 94 are separated from each other by air therebetween. The electrical connector 9 can be easily destroyed by an overvoltage condition, such as that caused by a nearly lightning strike, since the dielectric properties of the air between the curved portions 921*d* and the top wall 940 break down under a high voltage. Therefore, an improved electrical connector is desired to overcome the disadvantages of the prior art.

SUMMARY OF THE INVENTION

A major object of the present invention is to provide an electrical connector which can endure a relatively high voltage generated by lightning strike or other natural or man-made events in the connector's environment.

An electrical connector in accordance with the present invention comprises an insulative housing, first and second terminal modules, first and second covers, a pair of board locks and a conductive shield. The insulative housing comprises a front wall, a pair of side walls, an intermediate wall and a rear wall. The first and second terminal modules each comprises a dielectric spacer and a plurality of electrical terminals extending through the dielectric spacer. The terminal modules and the covers are assembled with the insulative housing and are retained by the side and intermediate walls. The covers abut against the front wall of the insulative housing and each comprises a plurality of passageways accommodating forward portions of electrical terminals extending beyond a front face of the dielectric spacer of one corresponding terminal module. A top wall of the conductive shield is separated from the electrical terminals by the spacers and the covers.

Other objects, advantages and novel features of the invention will become more apparent from the following detailed description of the present embodiment when taken in conjunction with the accompanying drawings.

DETAILED DESCRIPTION OF THE INVENTION

Figure 1:
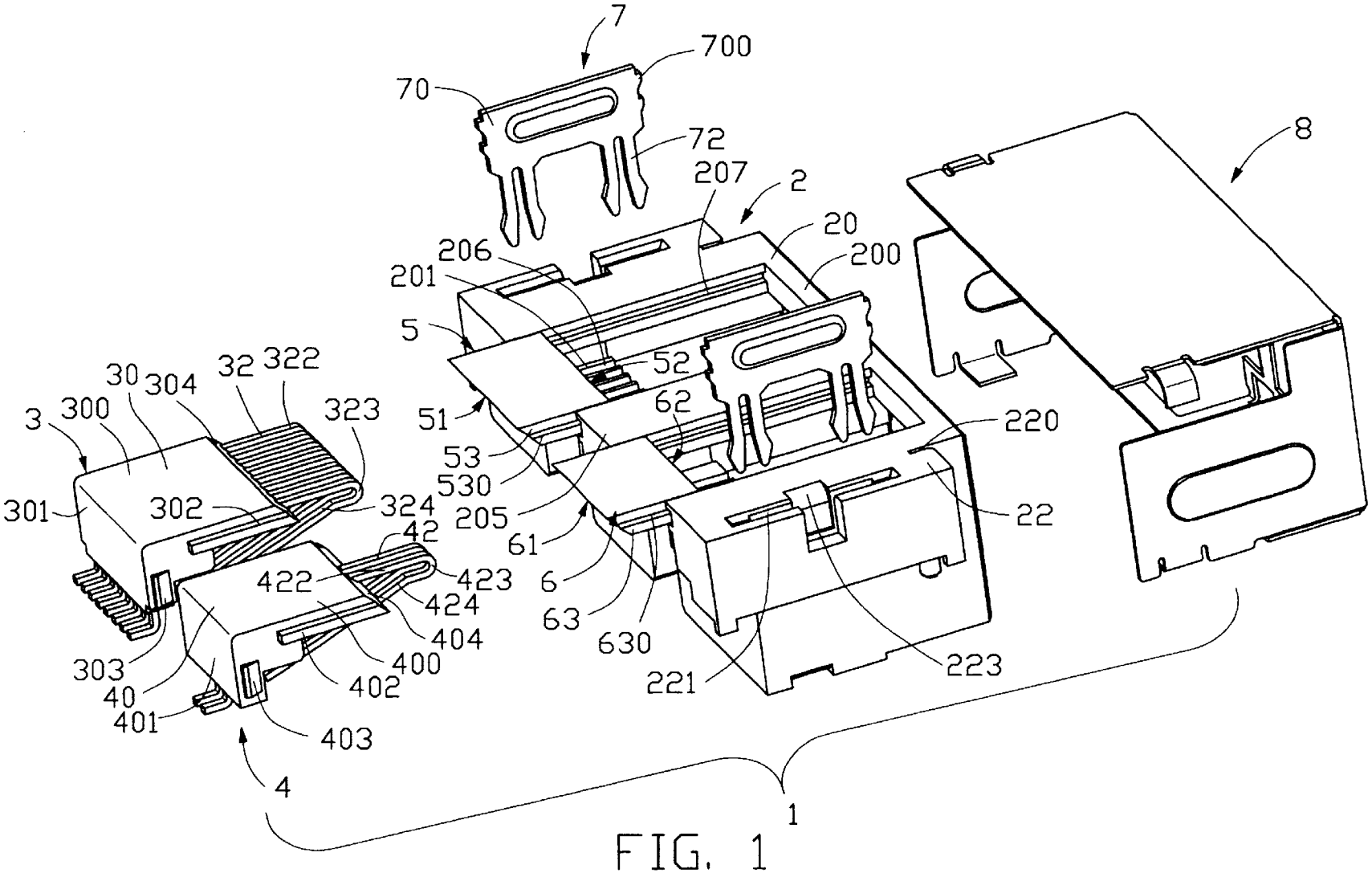
FIG. 1 is an exploded view of an electrical connector in accordance with the present invention.
Figure 2:
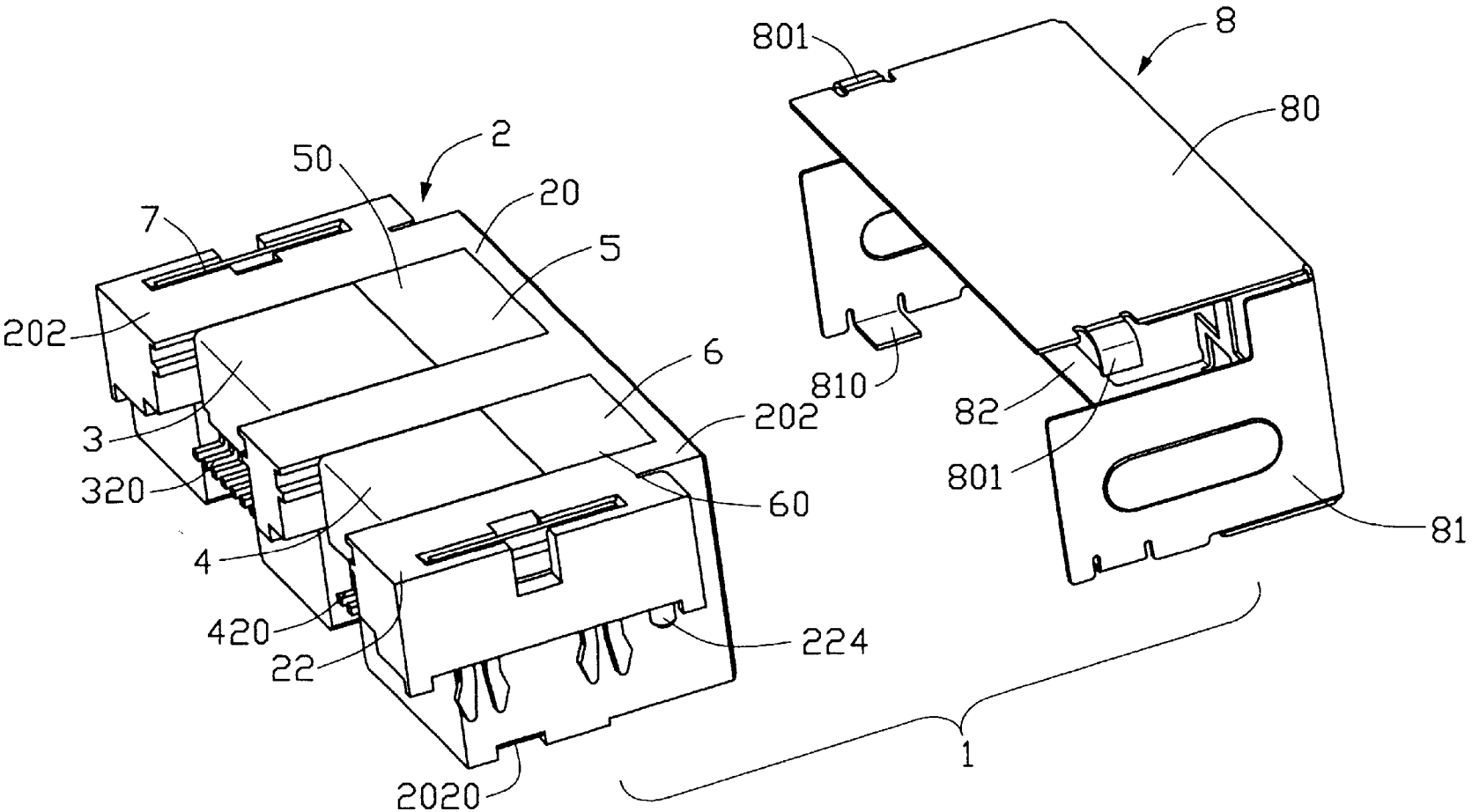
FIG. 2 is a partially assembled perspective view of FIG. 1.

Referring to FIGS. 1 and 2, an electrical connector 1 in accordance with the present invention comprises an insulative housing 2, first and second terminal modules 3, 4, insulative first and second covers 5, 6, a pair of board locks 7 and a conductive shield 8.

The insulative housing 2 comprises a body portion 20 and a pair of side wings 22 with an opening (not labeled) on a top portion of the housing 2. The body portion 20 comprises a front wall 200, a rear wall 201, a pair of side walls 202 and an intermediate wall 205. The side walls 202 and the intermediate wall 205 each defines a guiding groove 207 in an upper inner face thereof. The side walls 202 each defines a bottom recess 2020 in the bottom wall of the body portion 20 at an outer side thereof. The rear wall 201 defines a plurality of channels 206 longitudinally extending therethrough and open upwardly. The side wings 22 are formed on outer sides of the side walls 202, respectively, and each defines a slit 220 extending along forward and lower edges thereof and adjacent to one corresponding side wall 202. Each side wing 22 defines a slot 221 extending from a top to a bottom thereof and a recess 223 on an upper portion of an inner wall of the slot 221. A positioning pin 224 depends from a bottom face of each side wing 22.

Figure 3:
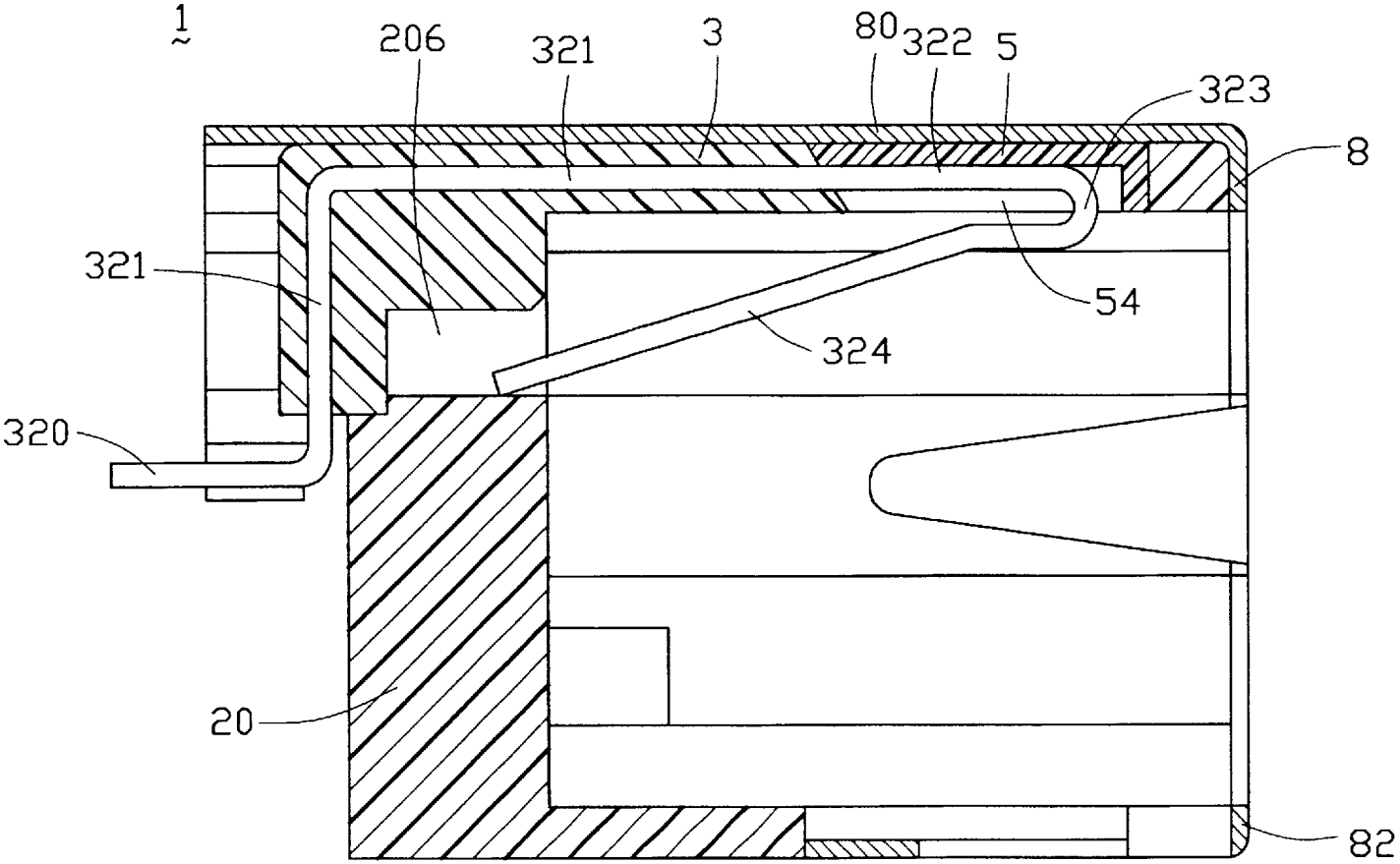
FIG. 3 is a cross-sectional view of the electrical connector of FIG. 1.
Figure 4:
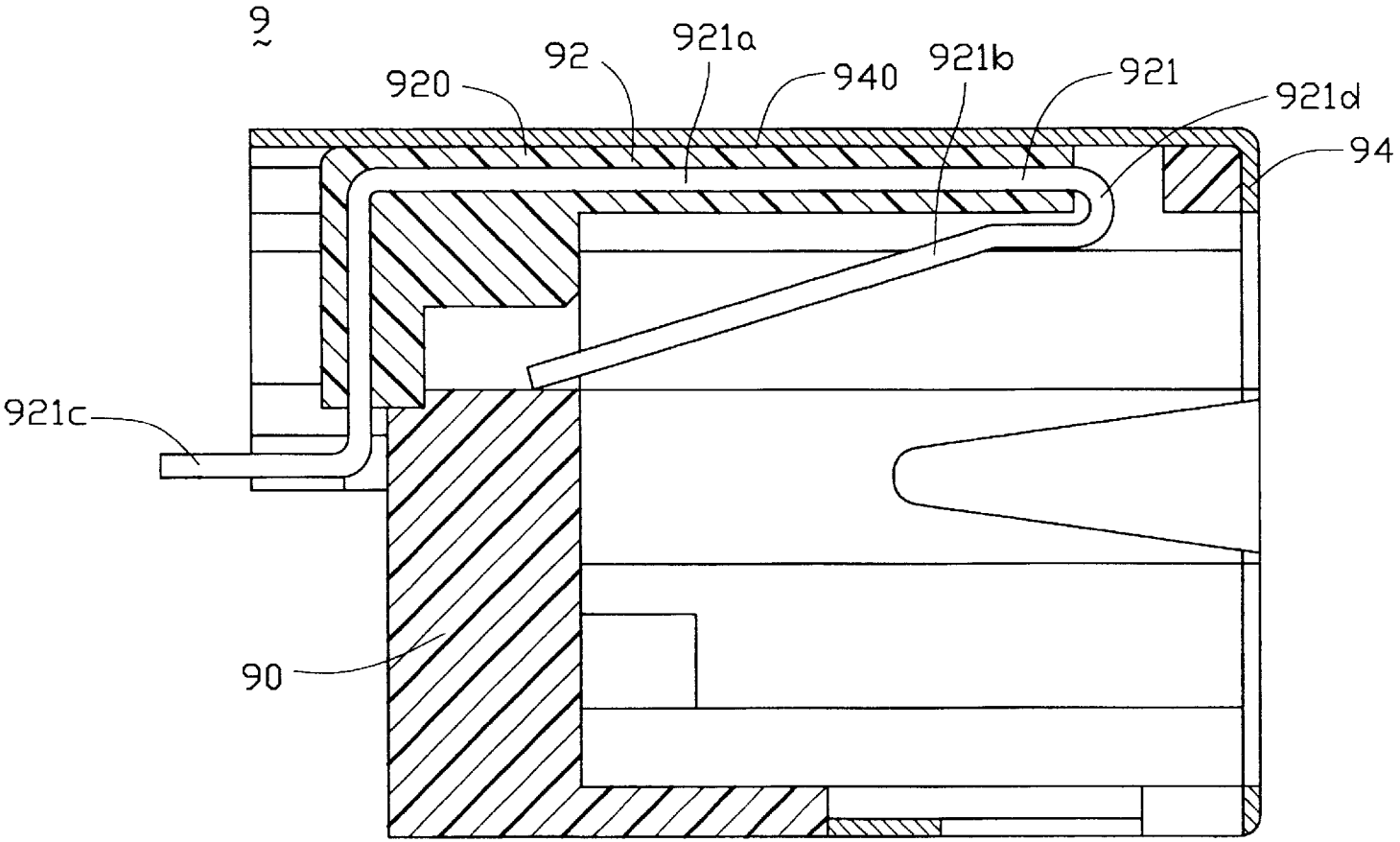
FIG. 4 (RELATED ART)
FIG. 4 is a cross-sectional view of a conventional electrical connector.

The first and second terminal modules 3, 4 are similar in shape to each other and each comprises a dielectric spacer 30, 40 and a plurality of electrical terminals 32, 42 extending through the dielectric spacer 30, 40. The dielectric spacers 30, 40 each comprises a guiding portion 300, 400 and a retention portion 301, 401. The guiding portion 300, 400 comprises a pair of guiding ribs 302, 402 protruding from forward portions of opposite side faces thereof and an inclined front face 304, 404. The retention portion 301, 401 forms a pair of barbs 303, 403 protruding from opposite outer side faces thereof. Referring also to FIG. 3, the electrical terminals 32, 42 each comprises a fixing portion 321 embedded in the dielectric spacer 30, 40, a mounting portion 320, 420 extending beyond the bottom of the retention portion 301, 401, a forward portion 322, 422 protruding beyond the front face 304, 404 of the guiding portion 300, 400, a curved portion 323, 423 extending from the forward portion 322, 422 and a spring arm 324, 424 extending angularly relative to the forward portion 322, 422 from the curved portion 323, 423.

The first and second covers 5, 6 are similar in shape to each other and each comprises a top face 50, 60 an inclined rear face 51, 61, a vertical front face 52, 62 and a pair of opposite side faces 53, 63. A pair of ribs 530, 630 protrude from opposite side faces 53, 63 of each of the first and second covers 5, 6. The first and second covers 5, 6 each defines a plurality of bottom passageways 54 (best shown in FIG. 3) in the bottom thereof.

The pair of board locks 7 each comprises a retaining portion 70 and two pairs of spaced mounting legs 72 extending downwardly from the retaining portion 70. A plurality of protrusions 700 are formed on opposite edges of the retaining portion 70.

Referring to FIG. 2, the conductive shield 8 comprises a top wall 80, a pair of side walls 81 separated from the top wall 80, and a front wall 82 connecting with the top and side walls 80, 81. The top wall 80 comprises a pair of outwardly and downwardly extending tongues 801 adjacent to a rear end thereof. The pair of side walls 81 each forms an inwardly extending support tongue 810 at a bottom edge thereof and parallel to the top wall 80.

In assembly, the ribs 530, 630 of the first and second covers 5, 6 are inserted forwardly along the guiding grooves 207 of the side and intermediate walls 202, 205 until the front faces 52, 62 are stopped by the front wall 200 of the insulative housing 2. The guiding ribs 302, 402 of the dielectric spacers 30, 40 of the first and second terminal modules 3, 4 are also inserted forwardly along the guiding grooves 207 of the side and intermediate walls 202, 205 before the inclined front faces 304, 404 of the dielectric spacers 30, 40 engage with the inclined rear faces 51, 61 of the first and second covers 5, 6, respectively. The forward and curved portions 322, 422, 323, 423 of the electrical terminals 32, 42 are received within the bottom passageways 54 of the first and second covers 5, 6. The barbs 303, 403 of the retention portions 301, 401 of the first and second terminal modules 3, 4 provide retention between the terminal modules 3, 4 and the side and intermediate walls 202, 205 of the insulative housing 2. Free ends of the spring arms 324, 424 of the electrical terminals 32, 42 are received in thechannels 206 of the rear wall 201. The board locks 7 are inserted through the slots 221 of the side wings 22. The retaining portions 70 of the board locks 7 are retained in the slots 221 while the mounting legs 72 extend downwardly beyond the bottom face of the side wings 22. The protrusions 700 provide reliable retention between the board locks 7 and the side wings 22. The conductive shield 8 is also assembled with the insulative housing 2, the top wall 80 thereof abutting against top faces of the insulative housing 2, the first and second dielectric spacers 30, 40 and the first and second covers 5, 6. The tongues 801 of the top wall 80 are retained in the recesses 223 of the insulative housing 2. The side walls 81 of the shield 8 cover outer side faces of the side walls 202 of the body portion 20 and are retained in the slits 220, respectively. The support tongues 810 of the side walls 81 extend into the bottom recess 2020 of the housing 2. The front wall 82 of the shield 8 covers the front wall 200 of the body portion 20.

The terminals 32, 42 of the first and second terminal modules 3, 4 are separated from the top wall 80 of the conductive shield 8 by the dielectric spacers 30, 40 and the insulative covers 5, 6, and because the resistance of the materials of the spacers 30, 40 and the covers 5, 6 is larger than the resistance of air, the electrical connector 1 is not so easily destroyed under high voltage conditions.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a front wall and a pair of side walls;

an insulative first cover retained by the side walls of the insulative housing and abutting against the front wall of the insulative housing;

a first terminal module comprising a dielectric spacer and a plurality of electrical terminals extending through the dielectric spacer, the dielectric spacer being retained by the side walls of the insulative housing and abutting against the insulative first cover; and a conductive shield enclosing the insulative housing, the first cover and the first terminal module and comprising a top wall, the top wall of the conductive shield being separated from the electrical terminals of the first terminal module by the insulative first cover and dielectric spacer of the first terminal module;

wherein the insulative housing further comprises an intermediate wall parallel to and in between the side walls and a rear wall opposite and parallel to the front wall;

further comprising an insulative second cover similar in shape to the insulative first cover and a second terminal module similar in shape to the first terminal module;

wherein the dielectric spacers of the first and second terminal modules each comprises a guiding portion forming a pair of opposite guiding ribs thereon and a retention portion retained to the intermediate and side walls of the insulative housing, the intermediate and side walls each defining a guiding groove corresponding to the guiding ribs of the dielectric spacers;

wherein the guiding portions of the dielectric spacers of the first and second terminal modules each define an inclined front face thereon;

wherein the first and second covers each form a pair of ribs on opposite side faces thereof and comprise a front face abutting against the front wall of the insulative housing and an inclined rear face engageable with the inclined front face of corresponding dielectric spacer, the ribs being received in the guiding grooves of the intermediate and side walls of the insulative housing;

wherein the electrical terminals of the first and second terminal modules each comprise a fixing portion embedded in the dielectric spacer, a mounting portion extending beyond a bottom of the retention portion, a forward portion extending beyond the front inclined face of the guiding portion, a curved portion extending from the forward portion and a spring arm extending angularly relative to the forward portion from the curved portion;

wherein the first and second covers each define a plurality of bottom passageways to receive the forward and curved portions of the electrical terminals;

wherein the rear wall of the insulative housing defines a plurality of channels to accommodate free ends of the spring arms of the electrical terminals;

further comprising a pair of board locks and wherein the insulative housing further comprises a pair of side wings on opposite side walls to retain the board locks therein.

* * * * *